US010923887B2

(12) United States Patent
Dal Re et al.

(10) Patent No.: US 10,923,887 B2
(45) Date of Patent: Feb. 16, 2021

(54) WIRE FOR AN IGNITION COIL ASSEMBLY, IGNITION COIL ASSEMBLY, AND METHODS OF MANUFACTURING THE WIRE AND IGNITION COIL ASSEMBLY

(71) Applicant: FEDERAL-MOGUL LLC, Southfield, MI (US)

(72) Inventors: Massimo Augusto Dal Re, Concordia Sulla Secchia (IT); Giovanni Betti Beneventi, Modena (IT); Stefano Papi, Modena (IT)

(73) Assignee: Tenneco Inc., Lake Forest, IL (US)

( * ) Notice: Subject to any disclaimer, the term of this patent is extended or adjusted under 35 U.S.C. 154(b) by 440 days.

(21) Appl. No.: 15/459,753

(22) Filed: Mar. 15, 2017

(65) Prior Publication Data

US 2018/0269660 A1 Sep. 20, 2018

(51) Int. Cl.
*H01T 19/00* (2006.01)
*H01B 1/02* (2006.01)
(Continued)

(52) U.S. Cl.
CPC ..... *H01T 19/00* (2013.01); *H01B 1/026* (2013.01); *H01F 17/045* (2013.01);
(Continued)

(58) Field of Classification Search
CPC . F02P 13/00; F02P 23/04; F02P 9/007; H01B 1/026; H01B 1/24; H01B 13/145;
(Continued)

(56) References Cited

U.S. PATENT DOCUMENTS 4,093,887 A 6/1978 Corbach et al.
4,366,464 A * 12/1982 Miyamoto ..... H01B 7/0063 338/214
(Continued)

FOREIGN PATENT DOCUMENTS

CN 1310144 A 8/2001
CN 204667905 U 9/2015
(Continued)

OTHER PUBLICATIONS (Journal of Applied Physics [online]. aip.scitation.org [retrieved on Apr. 20, 2010]. Retrieved from the Internet: URL: https://aip.scitation.org/doi/pdf/10.1063/1.3358017?class=pdf) (Year: 2010).*
(Continued)

*Primary Examiner* — Jared Fureman
*Assistant Examiner* — Nicolas Bellido
(74) *Attorney, Agent, or Firm* — Robert L. Stearns; Dickinson Wright, PLLC

(57) ABSTRACT

A wire for an ignition coil assembly and/or a corona ignition assembly is provided. The wire comprises a wire core including a copper-based material, and a coating applied to the wire core. The coating includes at least one of a carbon-based material and magnetic nanoparticles. The carbon-based material can include graphene and/or carbon nanotubes, and the magnetic nanoparticles can include graphene and iron oxide ($Fe_3O_4$). Typically, the coating includes a plurality of layers. For example, the coating can include a layer of the graphene and/or carbon nanotubes, and/or a layer of the magnetic nanoparticles. The coating can also include a layer of insulating material, such as enamel. According to another embodiment, the coating includes iron, nickel, and/or cobalt plated onto the wire core.

17 Claims, 4 Drawing Sheets

(51) Int. Cl.
*H01F 27/28* (2006.01)
*H01F 27/32* (2006.01)
*H01F 41/12* (2006.01)
*H01F 17/04* (2006.01)

(52) U.S. Cl.
CPC ..... *H01F 27/2823* (2013.01); *H01F 27/32* (2013.01); *H01F 41/12* (2013.01)

(58) Field of Classification Search
CPC .... H01B 7/0063; H01B 1/04; H01B 13/0016; H01B 13/003; H01B 13/0033; H01B 9/06; H01B 1/02; H01B 7/0208; H01B 7/18; H01B 7/30; H01B 13/065; H01B 13/32; H01B 7/00; H01B 3/303; H01B 3/305; H01B 3/306; H01B 7/28; H01F 17/045; H01F 2038/122; H01F 3/14; H01F 38/12; H01F 27/2823; H01F 27/32; H01F 41/12; H01F 27/306; H01F 27/321; H01F 27/327; H01F 1/143; H01T 13/50; H01T 19/00; H01T 21/02; Y10T 29/49002; B29C 48/15; B29K 2707/04; B29K 2995/0005; B29K 2995/0007; B29L 2031/3462; Y10S 977/742; Y10S 977/734; Y10S 977/788; Y10S 977/81; Y10S 977/831; Y10S 977/842; Y10S 977/948; Y10S 977/949; Y10S 977/95; B82Y 30/00; B82Y 99/00; C08K 3/04; C08K 3/041; C08K 3/042; C08K 3/044; C08K 3/046; H02K 3/30; H02H 7/228; H02H 7/226
USPC ..... 361/253, 255, 259, 263
See application file for complete search history.

(56) References Cited

U.S. PATENT DOCUMENTS 4,546,041 A * 10/1985 Keane ..... H01B 3/303 174/110 SR
4,757,297 A * 7/1988 Frawley ..... H01B 7/0063 174/36
5,660,397 A * 8/1997 Holtkamp ..... C09K 3/10 277/410
8,434,443 B2 * 5/2013 Lykowski ..... H01T 13/52 123/145 A
8,665,049 B2 3/2014 Miller
9,193,586 B2 11/2015 Wei et al.
9,251,927 B2 2/2016 Kim et al.
9,653,885 B2 * 5/2017 Urciuoli ..... H01T 19/04
2002/0026929 A1 3/2002 Shimada et al.
2003/0232144 A1 12/2003 Kikuchi et al.
2004/0031620 A1 * 2/2004 Lerchenmueller ..... H01B 3/306 174/120 R
2004/0210289 A1 10/2004 Wang et al.
2006/0119460 A1 6/2006 Farmer
2007/0235012 A1 * 10/2007 Lam ..... H01B 7/0063 123/633
2009/0004475 A1 * 1/2009 Sadaka ..... H01F 1/24 428/403
2010/0081744 A1 4/2010 Cancilleri et al.
2010/0101828 A1 * 4/2010 Duarte Pena ..... H01F 1/143 174/120 C
2012/0012362 A1 * 1/2012 Kim ..... H01B 3/004 174/118
2012/0125656 A1 * 5/2012 Wei ..... B82Y 30/00 174/103
2012/0176724 A1 * 7/2012 Burrows ..... H01T 13/50 361/263
2012/0212313 A1 * 8/2012 Burrows ..... F02P 9/007 336/90
2013/0140058 A1 6/2013 Kim et al.
2013/0140059 A1 6/2013 Koljonen et al.
2013/0293330 A1 * 11/2013 Wu ..... H01F 5/02 336/61
2013/0340697 A1 * 12/2013 Burrows ..... H01T 13/50 123/146.5 R
2013/0344237 A1 * 12/2013 Guo ..... B03C 1/00 427/127
2014/0232254 A1 8/2014 Ma et al.
2014/0268480 A1 * 9/2014 Urciuoli ..... H01T 19/04 361/263
2015/0194240 A1 7/2015 Ranganathan et al.
2016/0012942 A1 1/2016 Wei et al.
2016/0042837 A1 2/2016 Ranganathan et al.
2016/0228964 A1 * 8/2016 Perez ..... B23H 7/08
2018/0122529 A1 * 5/2018 Hwang ..... H01B 7/0009

FOREIGN PATENT DOCUMENTS

CN 105855647 A 8/2016
DE 2549931 A1 5/1977
EP 0984463 A1 3/2000
EP 1005126 A1 5/2000
EP 1983022 A1 10/2008
JP S5863713 U 4/1983
JP 05021240 A * 1/1993
JP 2016519833 A 7/2016
KR 101307982 B1 * 9/2013
KR 101561639 B1 * 10/2015
WO WO-2017039055 A1 * 3/2017 ..... H01B 1/02

OTHER PUBLICATIONS

International Search Report, dated Nov. 23, 2017 (PCT/US2017/022615).

* cited by examiner

WIRE FOR AN IGNITION COIL ASSEMBLY, IGNITION COIL ASSEMBLY, AND METHODS OF MANUFACTURING THE WIRE AND IGNITION COIL ASSEMBLY

BACKGROUND OF THE INVENTION

1. Field of the Invention

This invention relates generally to ignition coil wires for igniter assembles, including conventional and corona igniter assemblies, methods of manufacturing the ignition coil wires, and igniter assemblies including the ignition coil wires.

2. Related Art

Corona igniter assemblies for use in corona discharge ignition systems typically include an ignition coil assembly attached to a firing end assembly as a single component. The firing end assembly includes a center electrode charged to a high radio frequency voltage potential, creating a strong radio frequency electric field in a combustion chamber. The electric field causes a portion of a mixture of fuel and air in the combustion chamber to ionize and begin dielectric breakdown, facilitating combustion of the fuel-air mixture. The electric field is preferably controlled so that the fuel-air mixture maintains dielectric properties and corona discharge occurs, also referred to as non-thermal plasma. The ionized portion of the fuel-air mixture forms a flame front which then becomes self-sustaining and combusts the remaining portion of the fuel-air mixture. The electric field is also preferably controlled so that the fuel-air mixture does not lose all dielectric properties, which would create thermal plasma and an electric arc between the electrode and grounded cylinder walls, piston, or other portion of the igniter.

Conventional igniter assemblies also include an ignition coil assembly. In a conventional ignition system, the ignition coil assembly can include copper wires to provide the frequency and high-voltage electrical field needed to ignite the fuel in the combustion chamber of the engine. However, the electrical AC resistance of the wires (skin and proximity effects) can adversely affect the electrical efficiency of the system. Insufficient heat dissipation can be an issue as well.

SUMMARY OF THE INVENTION

One aspect of the invention provides a wire for an ignition coil assembly capable of providing reduced electrical AC resistance, improved heat dissipation, reliability, and sufficient mechanical support. The wire includes a wire core and a coating applied to the wire core. The wire core includes a copper-based material, and the coating includes at least one of a carbon-based material, magnetic nanoparticles, iron, nickel, and cobalt.

Another aspect of the invention provides a method of manufacturing a wire for an ignition coil assembly. The method includes the step of applying a coating to a wire core. The wire core includes a copper-based material, and the coating includes at least one of a carbon-based material, magnetic nanoparticles, iron, nickel, and cobalt.

Yet another aspect of the invention provides a corona igniter assembly comprising an ignition coil assembly. The ignition coil assembly includes at least one wire. The wire includes a coating applied to a wire core. The wire core includes a copper-based material, and the coating includes at least one of a carbon-based material, magnetic nanoparticles, iron, nickel, and cobalt.

Yet another aspect of the invention provides a method of manufacturing a corona igniter assembly including an ignition coil assembly. The method comprises connecting the ignition coil assembly to a firing end assembly. The ignition coil assembly includes at least one wire, and the wire includes a coating applied to a wire core. The wire core includes a copper-based material, and the coating includes at least one of a carbon-based material, magnetic nanoparticles, iron, nickel, and cobalt.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF EXEMPLARY EMBODIMENTS

Figure 1:
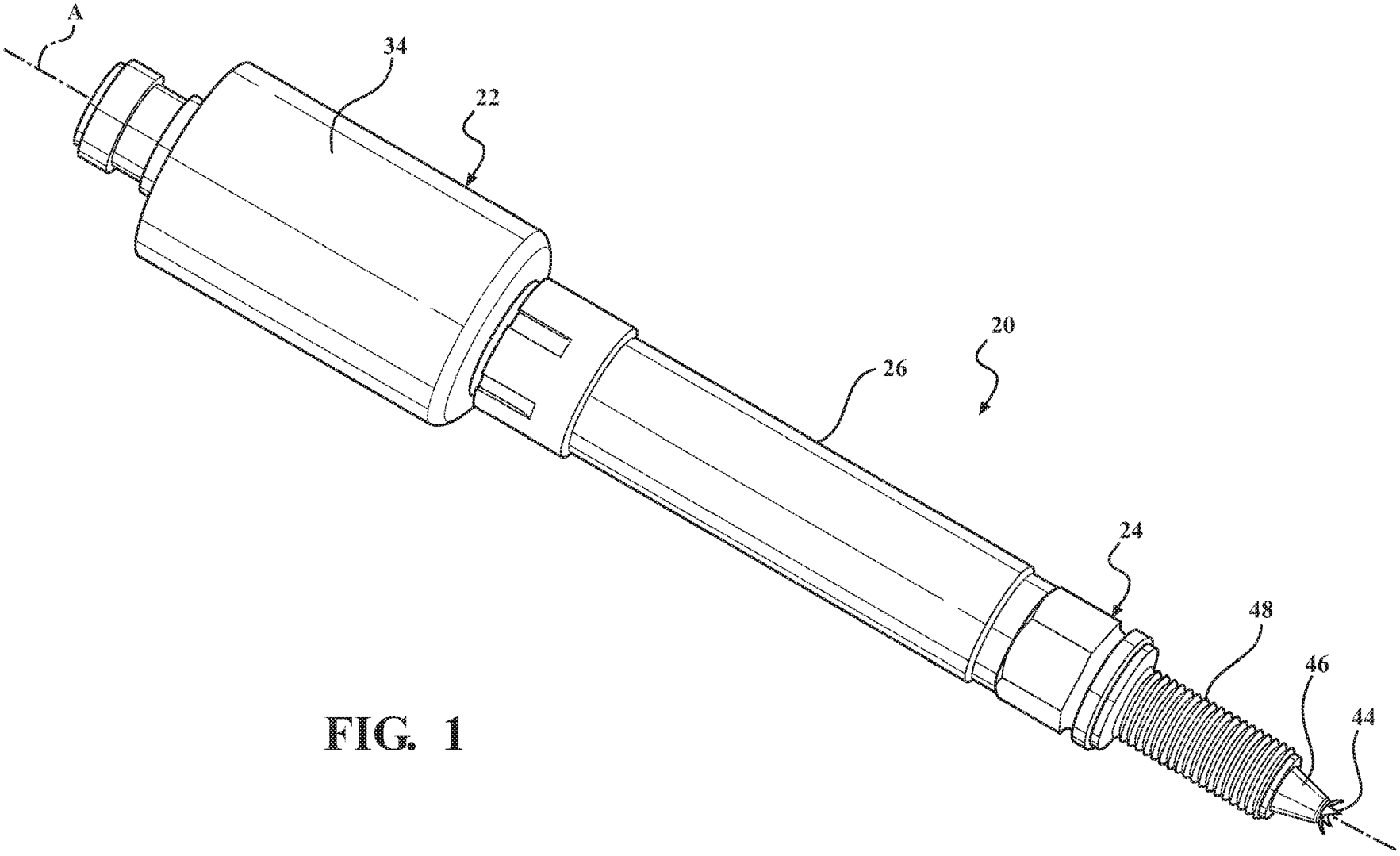
FIG. 1 is a perspective view of a corona igniter assembly comprising an ignition coil assembly connected to a firing end assembly according to an example embodiment.

A corona igniter assembly 20 for receiving a high radio frequency voltage and distributing a radio frequency electric field in a combustion chamber containing a mixture of fuel and gas to provide a corona discharge is generally shown in FIG. 1. The corona igniter assembly 20 includes an ignition coil assembly 22, a firing end assembly 24, and an extension 26 surrounding and coupling the ignition coil assembly 22 to the firing end assembly 24. The ignition coil assembly 22 includes at least one wire 28 for receiving energy from a power source at a first voltage and transmitting the energy to the firing end assembly 24 at a second voltage greater than the first voltage. The wire 28 can achieve reduced electrical AC resistance in the wire 28 and improved heat dissipation. The wire 28 is also reliable and has sufficient mechanical support.

The ignition coil assembly 22 can include only one wire 28, as shown in the Figures, which is typically wound and referred to as a winding. Alternatively, the ignition coil assembly 22 can include a plurality of the wires 28, also referred to as strands. For example, the wires 28 can form a "Litz" wire of any type, which is typically made of a bundle of twisted and insulated solid wires, also referred to as strands.

Figure 2:
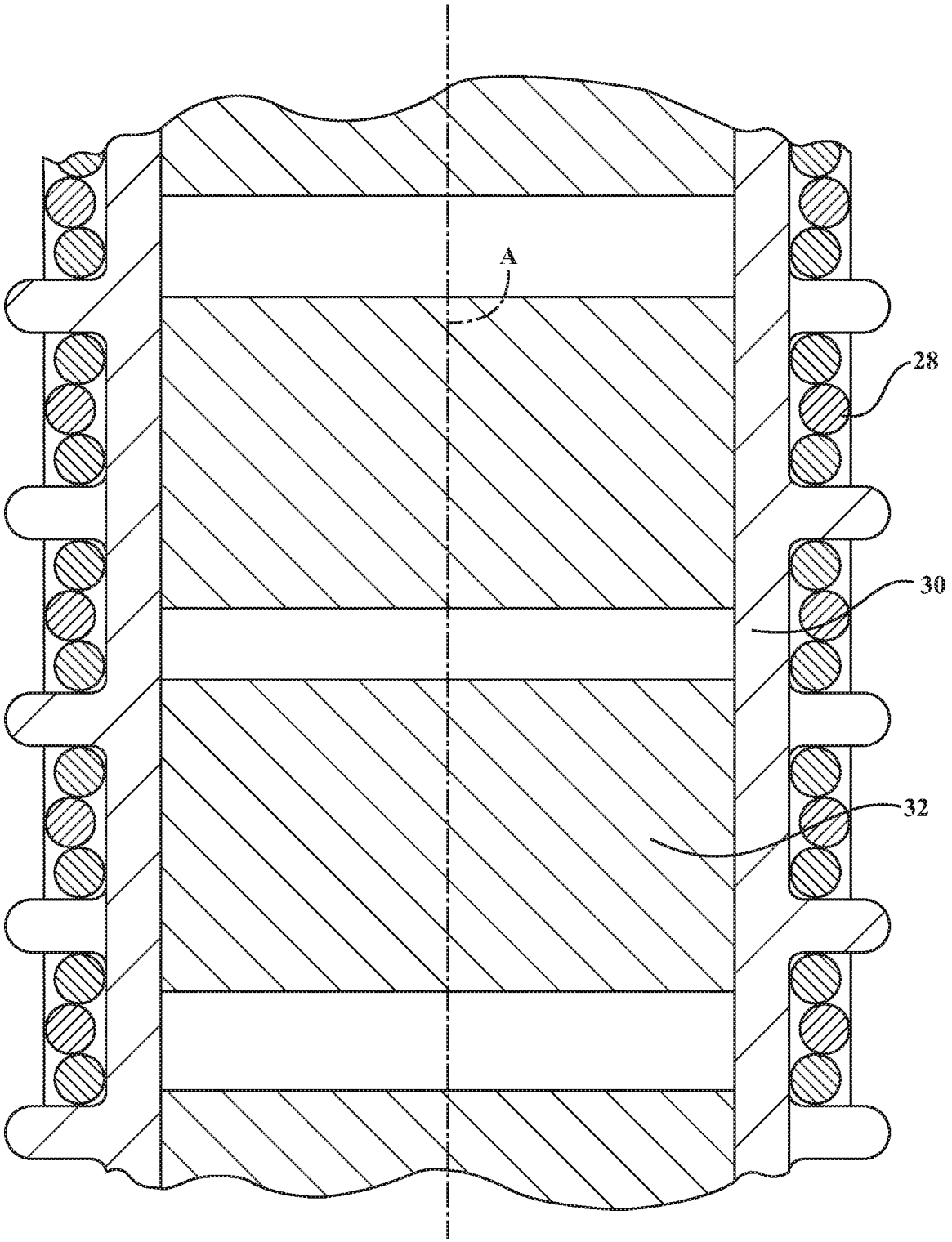
FIG. 2 is an enlarged cross-sectional view of a magnetic core, a coil support, and a wire wound around the wire support according to an example embodiment.

In the example embodiment of FIG. 2, the wire 28 of the ignition coil assembly 22 surrounds a center axis A of the corona ignition assembly 20. In this embodiment, the wire 28 is wound around a coil support 30 formed of a magnetic material, and the coil support 30 surrounds a magnetic core 32. However, wire 28 could be straight. In addition, the magnetic core 32 may or may not be present. For example, it is possible to operate the ignition coil assembly 22 at 1 MHz without a magnetic core 32. In addition, the improved wire 28 can behave as a "distributed" magnetic core, in which case the magnetic core 32 is not convenient. Also, at 1 MHz, the magnetic core 32 can experience losses due to eddy currents and magnetic saturation, and thus may not be desired. The ignition coil assembly 22 also typically includes an electrically conductive coil housing 34, as shown in FIG. 1, surrounding the wire 28. In the example embodiment, the housing 34 is sealed and filled with an electrically insulating material.

The improved ignition coil wire 28 can have several different designs which are each able to provide the reduced electrical AC resistance and improved heat dissipation. FIGS. 3, 4A, 4B, 5A, and 5B show cross sections of the ignition coil wire 28 according to example embodiments, which can be straight or wound around the center axis A. Each cross section shown can represent a single solid one of the wires 28, such as the only straight or wound wire 28 of the ignition coil assembly 22, or one of the wires 28 in the bundle forming the Litz wire. In each of the example embodiments, the wire 28 comprises a wire core 36 including a copper-based material. The wire core 36 typically consists entirely of the copper-based material, and the copper-based material typically consists of copper or a copper alloy. In the example embodiments, the wire core 36 has a diameter ranging from 1 mm to 10 mm.

The wire 28 of the ignition coil assembly 22 also includes a coating 38 applied to the wire core 36. The coating 38 typically includes or consists of at least one of a carbon-based material and magnetic nanoparticles or a magnetic nanoparticles-based material. The carbon-based material can include or consist of graphene and/or carbon nanotubes. Either single-wall nanotubes or multi-wall nanotubes can be used. According to one example embodiment, the magnetic nanoparticles-based material includes graphene and iron oxide ($Fe_3O_4$), or graphene oxide. The magnetic nanoparticles can be superparamagnetic nanoparticles. The magnetic nanoparticles or magnetic nanoparticles-based material can increase the inductance of the ignition coil assembly 22 when the wire 28 is wound to form a winding.

According to another embodiment, the coating 38 includes or consists of iron, nickel, and/or cobalt. These conducting magnetic materials can be plated onto the wire core 36, and they can be used alone or with the carbon-based material and/or magnetic nanoparticles or magnetic nanoparticles-based material. The coating 38 also typically includes an insulating material, such as enamel.

The coating 38 can include a single layer, but typically, the coating 38 includes a plurality of layers 40, 42, 44, as shown in FIGS. 3, 4A, 4B, 5A, and 5B. For example, one of the layers 40, 42, 44 of the coating 38 can include or consist of the carbon-based material or the magnetic nanoparticles-based material, and another one of the layers 40, 42, 44 of the coating 38 can include or consist of the insulating material. Typically, at least one of the layers 40, 42, 44 includes the graphene and/or carbon nanotubes, and/or at least one of the layers 40, 42, 44 includes the magnetic nanoparticles-based material. In the example embodiments, each of the layers 40, 42, 44 of the coating 38 has a thickness ranging from 10 nm to 1 mm.

Figure 3:
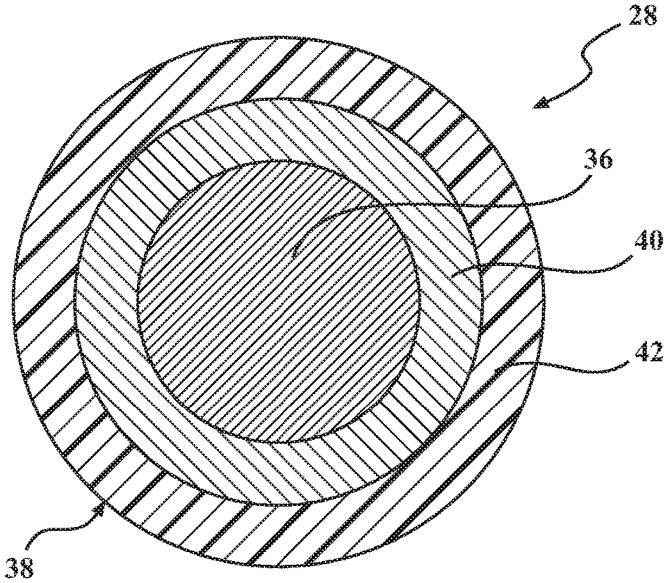
FIGS. 3, 4A, 4B, 5A, and 5B are cross-sectional views of wires for ignition coil assemblies according to example embodiments.

In the example embodiment shown in FIG. 3, the coating 38 of the wire 28 includes a first layer 40 including the graphene and/or carbon nanotubes disposed directly on the wire core 36, and a second layer 42 including the insulating material disposed directly on the first layer 40, outwardly of the first layer 40. In this example, the insulating material is enamel. This type of wire 28 can be referred to as a "hybrid wire." The wire 28 of FIG. 3 can provide increased electrical and thermal conductivities, thus reducing the AC resistance of the wire 28 and providing better heat dissipation compared to conventional copper wires.

Figure 4A:
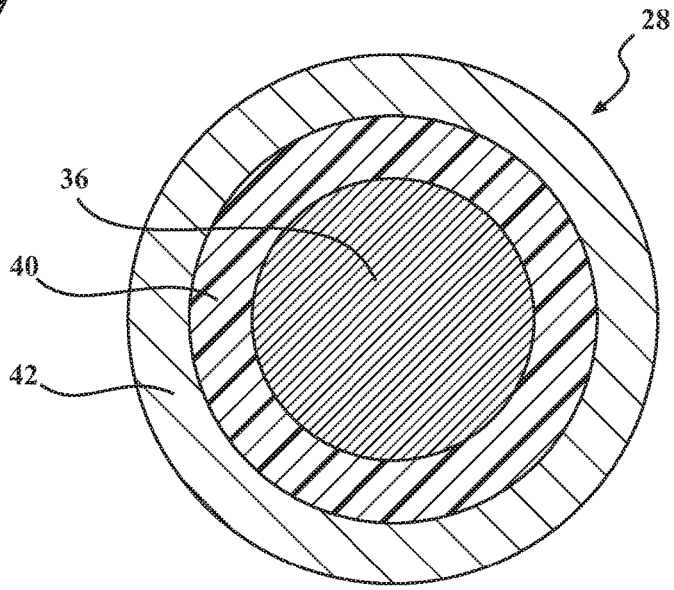
Figure 4B:
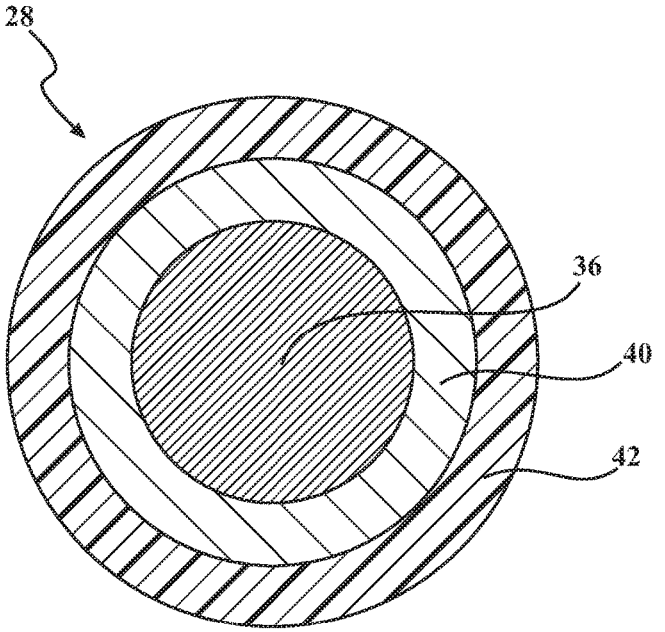

In the example embodiment of FIG. 4*a*, the first layer 40 includes the insulating material and is disposed directly on the wire core 36. The second layer 42 of the coating 38 includes the magnetic nanoparticles-based material and is disposed directly on the first layer 40, outwardly of said first layer 40. In the example embodiment of FIG. 4*b*, the first layer 40 includes the magnetic nanoparticles-based material and is disposed directly on the wire core 36. The second layer 42 of the coating 38 includes the insulating material and is disposed directly on the first layer 40, outwardly of the first layer 40. In these examples, the insulating material is enamel. The wires 28 of FIGS. 4*a* and 4*b* can both be referred to as a "nanomagnetoplated wire." The wires 28 of FIGS. 4*a* and 4*b* can provide an increased inductance, acting as a magnetic core "distributed" along the ignition coil assembly 22. The wire 28 of FIGS. 4*a* and 4*b* can also reduce magnetic field penetration within the copper wire core 36, hence reducing the proximity effects among adjacent wires, thus decreasing the electrical AC resistance.

Figure 5A:
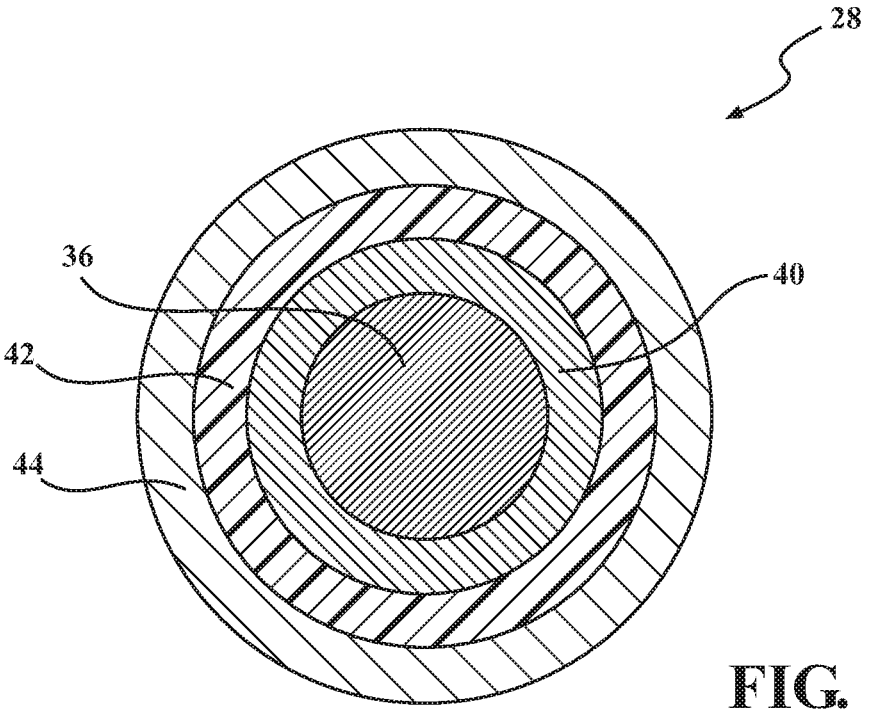
Figure 5B:
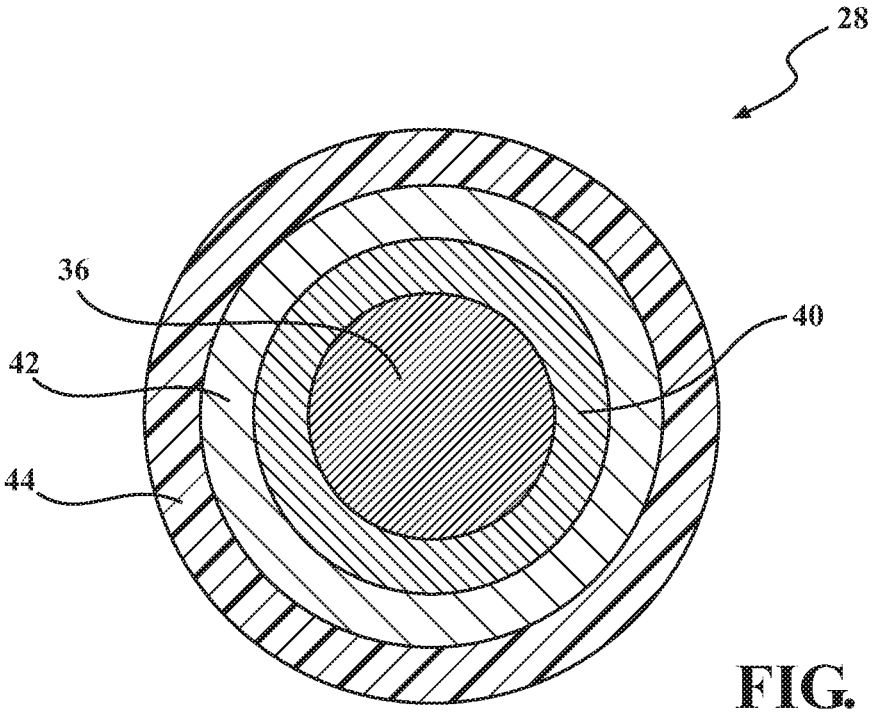

In the example embodiment of FIG. 5*a*, the first layer 40 includes the graphene and/or carbon nanotubes and is disposed directly on the wire core 36. The second layer 42 of the coating 38 includes the insulating material and is disposed directly on the first layer 40, outwardly of the first layer 40. In this embodiment, the coating 38 further includes a third layer 44 including the magnetic nanoparticles-based material disposed directly on the second layer 42, outwardly of the second layer 42. In the embodiment of FIG. 5*b*, the first layer 40 includes the graphene and/or carbon nanotubes and is disposed directly on the wire core 36. The second layer 42 includes the magnetic nanoparticles-based material and is disposed directly on the first layer 40, outwardly of the first layer 40. The third layer 44 includes the insulating material and is disposed directly on the second layer 42, outwardly of the second layer 42. In these examples, the insulating material is enamel. The wire 28 of FIGS. 5*a* and 5*b* can both be referred to as a "hybrid-nanomagnetoplated wire." The wire 28 of FIGS. 5*a* and 6*b* include a combination of coating materials to both increase inductance, electrical conductivity, and thermal conductivity. It is noted that if the magnetic nanoparticles-based material is a good insulator (e.g. but not exclusively graphene oxide with $Fe_3O_4$ inclusions) in the designs of FIGS. 5*a* and 5*b*, then the insulating function can be ascribed to the magnetic nanoparticles-based material and the insulator enamel layer can be removed. The insulating magnetic nanoparticles-based material can further reduce the eddy currents in the wound wire 28 compared to a conventional magnetic coating (e.g. nickel), thus providing reduced AC resistance and hence better performance.

As discussed above, the wire 28 of the ignition coil assembly 22 can comprise a single wire, as shown in the example embodiments. Alternatively, the ignition coil assembly 22 can include a plurality of the wires 28, each including the wire core 36 and coating 38 described above. For example, the wire 28 shown in the example embodiments can be used as single strands of any type of Litz wire.

As shown in FIG. 1, the ignition coil assembly 22 including the at least one wire 28 is connected to the firing end assembly 24 by the extension 26, which typically includes a metal tube. In the example embodiment, the firing end assembly 24 includes a center electrode (not shown) extending along the center axis A for receiving the energy from the ignition coil assembly 22 and distributing the energy in the form of a radio frequency electric field in a combustion chamber to ignite a mixture of fuel and air. In the example embodiment, the center electrode includes a firing tip 44 having a plurality of prongs presenting a terminal end of the center electrode. The firing end assembly 24 further includes an insulator 46, typically formed of a ceramic material, disposed around the center electrode. In this embodiment, the firing end assembly 24 includes a shell 48 formed of metal disposed around the insulator 46. The extension 26 typically connects the shell 48 of the firing end assembly 24 to the coil housing 34 of the ignition coil assembly 22. It is noted that the design of FIG. 1 is only an example. The ignition coil assembly 22, extension 26, and firing end assembly 24 can comprise various other designs, wherein the ignition coil assembly 22 contains the improved coil wire 28.

Another aspect of the invention provides a method of manufacturing the wire 28 described herein, which includes the step of applying the coating 38 to the wire core 36. Yet another aspect of the invention provides a method of manufacturing the corona igniter assembly 20 described above, which includes the step of connecting the ignition coil assembly 22 containing the at least one wire 28 to the firing end assembly 24.

Many modifications and variations of the present invention are possible in light of the above teachings and may be practiced otherwise than as specifically described while within the scope of the claims. It is also contemplated that all features of all claims and of all embodiments can be combined with each other, so long as such combinations would not contradict one another.

The invention claimed is:

1. A corona igniter assembly, comprising:

an ignition coil assembly including a coil support formed of a magnetic material and at least one wire, said at least one wire comprising a wire core including a copper-based material, said at least one wire including a coating applied to said wire core, and said coating including magnetic nanoparticles, and said magnetic nanoparticles including graphene and iron oxide ($Fe_3O_4$).

2. The corona igniter assembly of claim 1, wherein said coating includes a first layer including graphene and a second layer including said magnetic nanoparticles.

3. The corona igniter assembly of claim 1, wherein said first layer is disposed on said wire core, and a third layer including an insulating material is disposed outwardly of said first layer.

4. The corona igniter assembly of claim 1, wherein said coating comprises a third layer including an insulating material disposed on said wire core, and said second layer including said magnetic nanoparticles is disposed outwardly of said third layer.

5. The corona igniter assembly of claim 1, wherein said second layer including said magnetic nanoparticles is disposed on said wire core, and said coating includes a third layer including an insulating material disposed outwardly of said second layer.

6. The corona igniter assembly of claim 1, wherein said first layer is disposed on said wire core, a third layer including an insulating material is disposed outwardly of said first layer, and said second layer including said magnetic nanoparticles is disposed outwardly of said third layer.

7. The corona igniter assembly of claim 1, wherein said first layer is disposed on said wire core, said second layer including said magnetic nanoparticles is disposed outwardly of said first layer, and a third layer including an insulating material is disposed outwardly of said second layer.

8. The corona igniter assembly of claim 1, wherein said coating includes an insulating material.

9. The corona igniter assembly of claim 8, wherein said insulating material includes enamel.

10. The corona igniter assembly of claim 1, wherein said copper-based material of said wire core consists of a copper or copper alloy.

11. The corona igniter assembly of claim 1, wherein said wire core has a diameter ranging from 1 μm to 10 mm.

12. The corona igniter assembly of claim 1, wherein said layers each have a thickness ranging from 10 nm to 1 mm.

13. The corona igniter assembly of claim 1, wherein said wire core consists of a copper-based material for receiving energy at a first voltage and transmitting the energy to a firing end assembly at a second voltage greater than said first voltage, said copper-based material consists of copper or a copper alloy, said wire core has a diameter ranging from 1 μm to 10 mm, and each of said layers of said coating has a thickness ranging from 10 nm to 1 mm.

14. The corona igniter assembly of claim 1, wherein said at least one wire of said ignition coil assembly surrounds a center axis, said wire core consists of said copper-based material receiving energy at a first voltage and transmitting the energy to a firing end assembly at a second voltage greater than the first voltage, said copper-based material consists of copper or a copper alloy, said wire core has a diameter ranging from 1 μm to 10 mm, said coating includes a plurality of layers including at least a first layer and a second layer, said first layer of said coating includes graphene or said first layer of said coating includes said magnetic nanoparticles, said second layer of said coating includes an insulating material, said insulating material of said coating includes enamel, each of said layers of said coating has a thickness ranging from 10 nm to 1 mm, said wire is wound around said coil support, said coil support optionally surrounds a magnetic core, said ignition coil assembly includes a coil housing surrounding said wire that is wound around said coil support, said housing is sealed and filled with an electrically insulating material, said firing end assembly includes a center electrode extending along said center axis for receiving the energy from said ignition coil assembly and distributing the energy in the form of a radio frequency electric field to ignite a mixture of fuel and air, said center electrode includes a firing tip having a plurality of prongs presenting a terminal end of said center electrode, said firing end assembly includes an insulator formed of a ceramic material disposed around said center electrode, said firing end assembly includes a shell formed of metal disposed around said insulator, and a tube formed of metal connecting said shell of said firing end assembly to said coil housing of said ignition coil assembly.

15. The corona igniter assembly of claim 1, wherein said coating further includes cobalt.

16. A method of manufacturing a corona igniter assembly, comprising the step of:

connecting an ignition coil assembly to a firing end assembly, the ignition coil assembly including a coil support formed of a magnetic material and at least one wire, the at least one wire comprising a wire core including a copper-based material, the at least one wire comprising a coating applied to the wire core, the coating including magnetic nanoparticles, and the magnetic nanoparticles including graphene and iron oxide ($Fe_3O_4$).

17. The method of claim 16, wherein a first layer includes said graphene and a second layer includes said magnetic nanoparticles.

* * * * *